US009453662B2

(12) United States Patent
Xu et al.

(10) Patent No.: US 9,453,662 B2
(45) Date of Patent: Sep. 27, 2016

(54) CRYOGENIC REFRIGERATOR

(75) Inventors: Mingyao Xu, Tokyo (JP); Takaaki Morie, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 413 days.

(21) Appl. No.: 13/616,385

(22) Filed: Sep. 14, 2012

(65) Prior Publication Data

US 2013/0074524 A1 Mar. 28, 2013

(30) Foreign Application Priority Data

Sep. 28, 2011 (JP) ..... 2011-212240

(51) Int. Cl.
*F25B 9/00* (2006.01)
*F25B 9/14* (2006.01)
*F04B 53/00* (2006.01)

(52) U.S. Cl.
CPC ..... *F25B 9/14* (2013.01); *F04B 53/008* (2013.01)

(58) Field of Classification Search
CPC .. F25B 9/14; F25B 2309/001; F04B 53/008; F04B 53/02; F04B 53/148; F04B 2201/0208
USPC ..... 62/6; 92/145, 181 R, 186
See application file for complete search history.

(56) References Cited

U.S. PATENT DOCUMENTS 5,387,252 A * 2/1995 Nagao ..... F25B 9/10 62/196.2
5,447,034 A * 9/1995 Kuriyama ..... F16J 9/062 148/301
5,481,879 A * 1/1996 Asami ..... F25B 9/14 60/520
2010/0229572 A1* 9/2010 Raiju ..... F25B 9/14 62/6

FOREIGN PATENT DOCUMENTS

| | | |
|---|---|---|
| CN | 101900447 | 12/2010 |
| JP | 61-190255 | 8/1986 |
| JP | 2004-144461 | 5/2004 |
| WO | WO 2012/027918 | 3/2012 |

OTHER PUBLICATIONS

JP 2004-144461 Translation.*

* cited by examiner

*Primary Examiner* — Frantz Jules
*Assistant Examiner* — Brian King
(74) *Attorney, Agent, or Firm* — IPUSA, PLLC

(57) ABSTRACT

A disclosed device cryogenic refrigerator includes a first stage displacer; a first stage cylinder configured to form a first expansion space between the first stage cylinder and the first stage displacer; a second stage displacer connected to the first stage displacer; and a second stage cylinder configured to form a second expansion space between the second stage cylinder and the second stage displacer, wherein a helical groove is formed on an outer peripheral surface of the second stage displacer so as to helically extend from a side of the second expansion space toward the first stage displacer, wherein the second stage cylinder includes a first flow resistor communicating with a side of the first stage displacer in the helical groove, and a buffer portion communicating with a side of the first stage displacer in the first flow resistor.

3 Claims, 5 Drawing Sheets

CRYOGENIC REFRIGERATOR

CROSS-REFERENCE TO RELATED APPLICATIONS

This patent application is based upon and claims the benefit of priority of Japanese Patent Application No. 2011-212240 filed on Sep. 28, 2011, the entire contents of which are incorporated herein by reference.

BACKGROUND OF THE INVENTION

1. Field of the Invention

The present invention generally relates to a cryogenic refrigerator which generates cold (a cold thermal energy causing an ultra-low temperature) by generating Simon expansion using a high-pressure refrigerant gas supplied from a compression device.

2. Description of the Related Art

For example, the Patent Document 1 discloses a Gifford-McMahon (GM) refrigerator causing a gas existing inside a gap between a piston of the GM refrigerator and a cylinder of the GM refrigerator to expand. The GM refrigerator includes a linear groove extending in an axial direction which functions as an orifice.

[Patent Document 1] Chinese Laid-open Patent Publication No. 101900447A

SUMMARY OF THE INVENTION

According to an aspect of the present invention, there is provided a regenerative type refrigerator including: a first stage displacer; a first stage cylinder configured to form a first expansion between the first stage cylinder and the first stage displacer; a second stage displacer connected to the first stage displacer; and a second stage cylinder configured to form a second expansion space between the second stage cylinder and the second stage displacer, wherein a helical groove is formed on an outer peripheral surface of the second stage displacer so as to helically extend from a side of the second expansion space toward the first stage displacer, wherein the second stage cylinder includes a first flow resistor communicating with a side of the first stage displacer in the helical groove, and a buffer portion communicating with a side of the first stage displacer in the first flow resistor.

DETAILED DESCRIPTION OF THE PREFERRED EMBODIMENTS

According to the above structure disclosed in the Patent Document 1, a high temperature side of the linear groove repeatedly enters into and exits from an expansion space on a side of a first stage while the two-stage type displacer reciprocates.

Therefore, the flow path resistance of the orifice changes. Therefore, there is a problem that refrigeration efficiency is not enhanced.

The object of the embodiments of the present invention is to provide a cryogenic refrigerator which can effectively enhance refrigeration efficiency solving one or more of the problems discussed above.

Preferred embodiments of the present invention are explained next with reference to accompanying drawings.

First Embodiment

Figure 1:
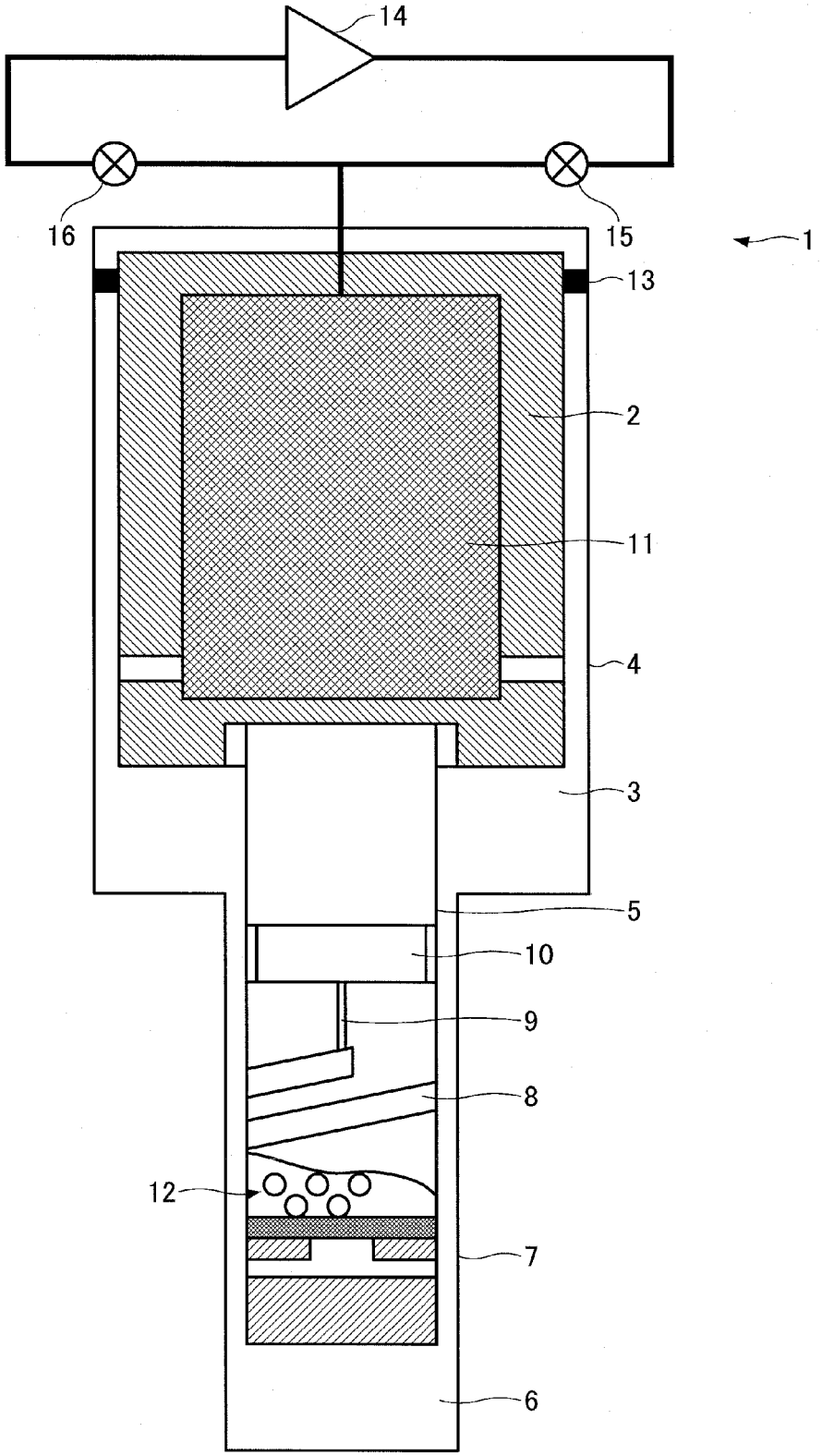
FIG. 1 schematically illustrates an exemplary cryogenic refrigerator of a first embodiment.

A cryogenic refrigerator 1 of the first embodiment may be of a Gifford-McMahon (GM) type. Referring to FIG. 1, the cryogenic refrigerator 1 includes a first stage displacer 2, a first stage cylinder 4 forming a first expansion space 3 between the first stage cylinder 4 and the first stage displacer 2, a second stage displacer 5 connected to the first stage displacer 2, and a second stage cylinder 7 forming a second expansion space 6 between the second stage cylinder 7 and the second stage displacer 5.

Further, the cryogenic refrigerator 1 includes a helical groove formed on an outer peripheral surface of the second stage displacer 5 and helically extends from the second expansion space 6, a first flow resistor 9 communicating with the helical groove 8 on a side of the first stage displacer 2, and a buffer portion 10 communicating with the first flow resistor 9 on a side of the first expansion space 3. The buffer portion 10 is always positioned on a side of the second expansion space 6 relative to the first expansion space 3.

The first stage displacer 2 and the second stage displacer 5 have cylindrical outer peripheral surfaces, respectively. A first regenerator 11 is provided inside the first stage displacer 2. A second regenerator 12 is provided inside the second stage displacer 5. A sealing portion 13 is provided between a portion on the high temperature side of the first stage displacer 2 and the first stage cylinder 4. A supply and discharge pipe is connected to the upper end of the first stage cylinder 4. The supply and discharge pipe is included in pipes for connecting various parts of a supply and discharge system such as a compressor 14, a supply valve 15, and a return valve 16.

An axis member (not illustrated) is connected to the upper end of the first stage displacer 2. The axis member protrudes from the upper end of the first stage cylinder 4 and is connected to a driving motor (not illustrated) via a crank mechanism (not illustrated). The axis member, the crank mechanism, and the driving motor form a driving mechanism for reciprocating the first stage displacer 2 and the second stage displacer 5 in the axial directions.

The first stage displacer 2 is accommodated inside the first stage cylinder 4, which is shaped like an upside-down bottomed cylinder (a capped cylinder) having a opened lower end. The second stage displacer 5 is accommodated inside the second stage cylinder 7, which is shaped like an upside-down bottomed cylinder (a capped cylinder) having an opened lower end. The first stage cylinder 4 and the second stage cylinder 7 are integrally formed.

For example, stainless steel may be used as a material of the first and second stage cylinders 4 and 7 to achieve high strength, low thermal conductivity, and sufficient helium interruption capability. For example, a phenol resin including fabric or the like is used for the first stage displacer 2 to obtain a lighter specific gravity, more sufficient wear resistance, higher strength, and lower thermal conductivity. The second stage displacer 5 may be a metallic cylinder on the outer periphery of which a coating such as fluorine contained resin having high wear resistance is provided. The first regenerator 11 may be formed by a first regenerator material such as a screen. The second regenerator 12 may be formed by holding a regenerator material such as lead spheres in the axial directions by felt and screens.

Figure 2:
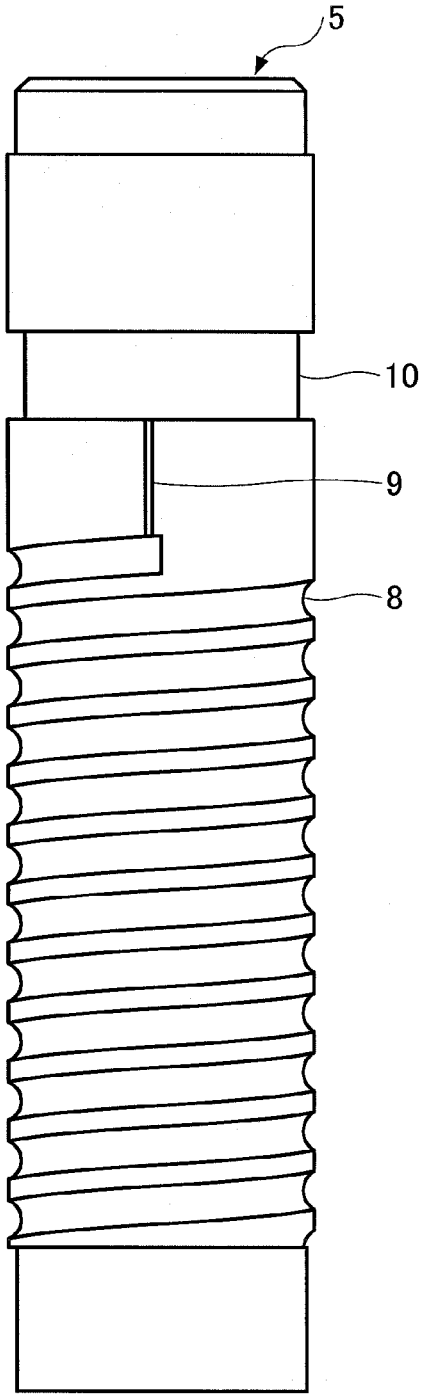
FIG. 2 illustrates a part of the exemplary cryogenic refrigerator of the first embodiment.

The helical groove 8 is formed on the outer peripheral surface of the second stage displacer 5. Referring to FIG. 2, the helical groove 8 has a start end communicating with the second expansion space 6 which is formed in the low temperature side of the first stage cylinder 4, helically extends on the side of the first expansion space 3, and has a final end ending at a portion positioned on the high temperature side relative to the center in the axial direction of the second stage displacer 5.

The first flow resistor 9 in a groove-like shape is formed on the outer peripheral surface of the second stage displacer 5 and extends from the final end of the helical groove 8. The final end of the first flow resistor 9 communicates with the buffer portion formed on the outer peripheral surface of the second stage displacer 5. Referring to FIG. 1, at the upper dead centers of the first stage displacer 2 and the second stage displacer 5, the buffer portion 10 is positioned on a lower side of the bottom surface of the first stage cylinder 4.

As described, the buffer portion 10 always exists on the side of the second expansion space 6 relative to the first expansion space 3. When the first stage displacer 2 is positioned at the upper dead center where the first expansion space 3 becomes maximum, the buffer portion 10 is entirely positioned on the side of the second expansion space 6 relative to an exposing portion of the outer peripheral surface of the second stage displacer 5 exposed to the first expansion space 3. Referring to FIG. 2, a portion of the second stage displacer 5 positioned on the high temperature side of the buffer portion 10 of the outer peripheral surface of the second stage displacer 5 forms a clearance sealing portion. The clearance sealing portion is provided to reduce a gap between the inner surface of the first stage cylinder 4 and the outer peripheral surface of the second stage displacer 5 in radius directions.

The buffer portion 10 is recessed in the radius direction of the second stage displacer 5 from the outer peripheral surface of the second stage displacer 5 to thereby form an annular area extending in the peripheral directions of the second stage displacer 5. The volume of the annular space formed between the buffer portion 10 and the inner peripheral surface of the second stage cylinder 7 is at least more than half of the total volume of the helical groove 8.

When the compressor 14 is operated and the supply valve 15 is opened, a high pressure helium gas is supplied from the above supply and discharge pipe into the first stage cylinder 4 via the supply valve 15. The high pressure helium gas is further supplied to the first expansion space 3 via a communicating passage for communication of the refrigerant gas between an upper end inside the first stage displacer 2 and the first regenerator 11 and a communicating passage for communication of the refrigerant gas between the first regenerator 11 and the first expansion space 3.

The high pressure helium gas supplied to the first expansion space 3 is further supplied to the second regenerator 12 via a communicating passage for communication of the refrigerant gas between the first expansion space 3 and the second regenerator 12, and is supplied to the second expansion space 6 via a communicating passage for communication of the refrigerant gas between the second regenerator 12 and the second expansion space 6. A part of the high pressure helium gas supplied to the second expansion space 6 is supplied inside the helical groove 8 from the low temperature side.

Figure 3:
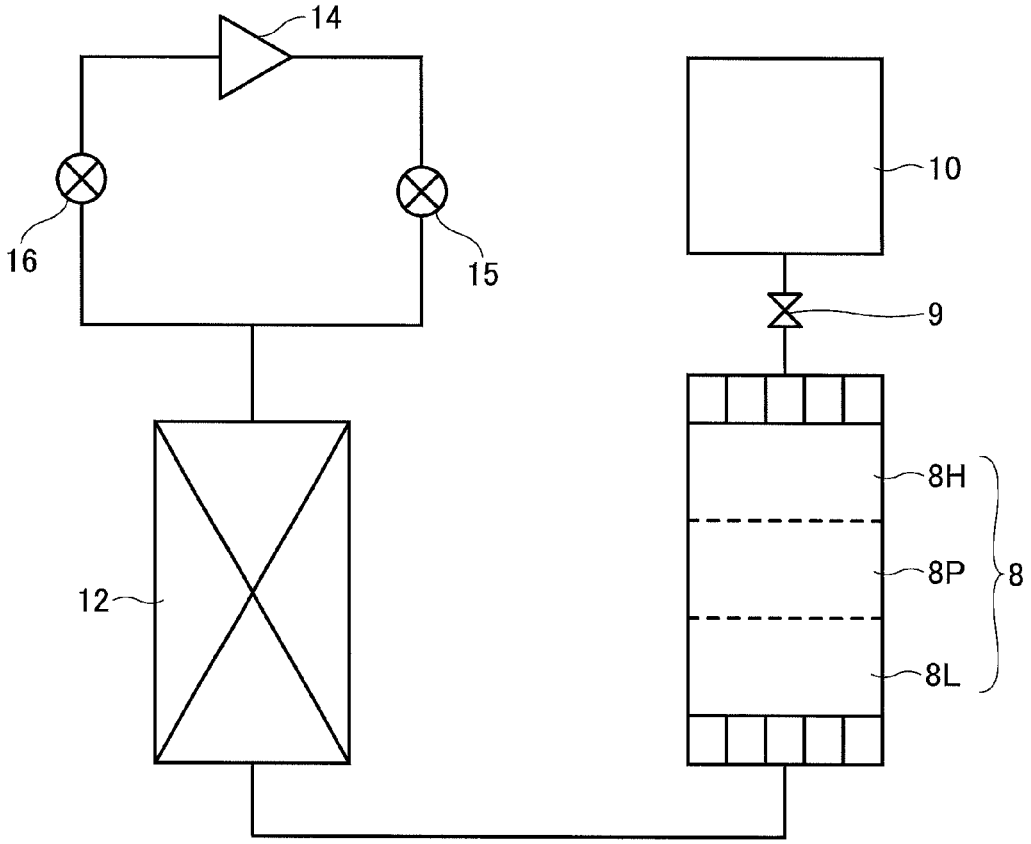
FIG. 3 schematically illustrates a flow of a gas in which a side clearance of the cryogenic refrigerator of a first embodiment is regarded as a pulse tube of a virtual pulse tube refrigerator.

FIG. 3 illustrates a flow of the refrigerant gas in which the helical groove 8 is regarded as a virtual pulse tube of a pulse tube refrigerator. The first flow resistor 9 corresponds to a virtual orifice arranged on the communicating passage for the communication between the buffer portion 10 functioning as a buffer and the high temperature side of the helical groove 9 functioning as the pulse tube. The refrigerant gas inside the helical groove 8 corresponds to a virtual gas piston 8P (a substantially center portion of the helical groove 8 in the axial direction) in FIG. 3.

The length of the virtual gas piston 8P in the axial direction and the phase of the virtual gas piston 8P may be adjusted so that the virtual gas piston 8P is always accommodated inside the helical groove 8 during reciprocation of the helical groove 8 and so that a high temperature side space 8H exists on the high temperature side of the virtual gas piston 8P and a low temperature side space 8L exists on the low temperature side of the virtual gas piston 8P. The length of the virtual gas piston 8P in the axial direction and the phase of the virtual gas piston 8P are adjusted by changing the volume of the buffer portion (the buffer) 10 functioning as a phase shifting mechanism and the cross-sectional area of the first flow resistor (the orifice) 9.

Next, the operation of the refrigerator is described. At a certain time point of supplying the refrigerant gas, the first stage displacer 2 and the second stage displacer 5 are positioned at lower dead centers in the first stage cylinder 4 and the second stage cylinder 7, respectively. At this timing or a timing slightly different from this timing, the supply valve 15 is opened. Then, a high pressure helium gas is supplied inside the first stage cylinder 4 from the supply and discharge pipe via the supply valve 15. The high pressure helium gas flows inside the first stage displacer 2 (into the first regenerator 11) from an upper portion of the first stage displacer 2. The high pressure helium gas flowing inside the first regenerator 11 is supplied into the first expansion space 3 via the communicating passage positioned at the lower portion of the first stage displacer 2 while being cooled by the first regenerator material.

The high pressure helium gas supplied to the first expansion space 3 is supplied to the second regenerator 12 inside the second stage displacer 5 via a communicating passage (not illustrated). Because the second stage displacer 5 includes the clearance sealing portion on the end portion on the high temperature side, it is possible to prevent the helium gas from bi-directionally flowing from the first expansion space 3 to the buffer portion 10.

At this time point, the pressure of the helium gas inside the helical groove 8 is substantially the same as the pressure of the compressor 14 on the low pressure side. Meanwhile, the helium gas inside the buffer portion 10 has a pressure which is an intermediate pressure between the high and low pressures of the compressor 14. Therefore, the helium gas inside the buffer portion 10 flows into the high temperature side of the helical groove 8 via the first flow resistor 9.

The high pressure helium gas flown into the second regenerator 12 is supplied to the second expansion space 6 via the communicating passage while being further cooled by the second regenerator material. A part of the high pressure helium gas supplied to the second expansion space 6 is supplied inside the helical groove 8 from the low temperature side. This gas corresponds to the helium gas existing inside the low temperature side space 8L in FIG. 3.

As described, since the cross-sectional area of the first flow resistor 9 is smaller than the cross-sectional area of the helical groove 8, the inflow resistance of the helium gas flowing inside the helical groove 8 flowing into the high temperature side space 8H (flowing inside the helical groove 8) from the buffer portion 10 is greater than the inflow resistance of the helium gas flowing into the low temperature side space 8L (flowing inside the helical groove 8). Therefore, the amount of the helium gas flowing inside the high temperature side space 8H is smaller than the amount of the helium gas flowing inside the low temperature side space 8L thereby preventing the gas in the high temperature side space 8H from flowing into the second expansion space 6. On the other hand, a part of the helium gas in the high temperature side space 8H may be pushed by the virtual gas piston 8P so as to flow into the buffer portion 10.

As described, the first expansion space 3, the second expansion space 6 and the helical groove 8 are filled with the high pressure helium gas and the supply valve 15 is closed. At this time, the first stage displacer 2 and the second stage displacer 5 are positioned at the upper dead centers in the first stage cylinder 4 and the second stage cylinder 7, respectively. At this timing or a timing slightly different from this timing, the return valve 16 is opened. Then, the refrigerant gas inside the first expansion space 3, the second expansion space 6 and the helical groove 8 are depressurized to thereby expand. The helium gas inside the first expansion space 3 having a low temperature by the expansion absorbs heat of a first cooling stage (not illustrated) and the helium gas in the second expansion space 6 absorbs heat of a second cooling stage (not illustrated).

The first stage displacer 2 and the second stage displacer 5 move toward the lower dead centers thereby reducing the volumes of the first expansion space 3 and the second expansion space 6. The helium gas inside the second expansion space 6 is recovered into the first expansion space 3 via the second regenerator 12. The helium gas on the low temperature side space 8L of the helical groove 8 is recovered via the second expansion space 6.

The helium gas in the first expansion space 3 returns to the compressor 14 via the first regenerator 11 to a suction side of the compressor 14. At this time, the first regenerator material and the second regenerator material are cooled by the refrigerant gas. These processes form one cycle. The first cooling stage and the second cooling stage are cooled by repeating the cycle.

The following functions and effects are obtainable by the cryogenic refrigerator 1 of the first embodiment. The virtual gas piston 8P is realized inside the helical groove 8 forming the side clearance between the second stage displacer 5 and the second stage cylinder 7 to cause the gas piston 8P to function as the sealing portion for preventing the helium gas from communicating between the high and low temperature sides of the side clearance.

Said differently, the side clearance between the outer peripheral surface of the second displacer 5 and the inner peripheral surface of the second stage cylinder 7 prevents the helium gas from bi-directionally moving thereby preventing generation of leakage loss. Thus, the refrigeration efficiency can be enhanced.

Additionally, the side clearance can be regarded as a virtual pulse tube refrigerator. Then, it is possible to use the low temperature side space 8L on the low temperature side of the gas piston 8P can be used as a third expansion space. Thus, it is possible to enhance refrigeration efficiency.

Further, the orifice forming the phase shifting mechanism for adjusting the length of the virtual gas piston 8P in the axial direction and the phase of the virtual gas piston 8P is realized by the first flow resistor 9 in a groove-like shape extending in the axial direction on the outer peripheral surface of the second stage displacer 5, and the buffer is realized by the buffer portion 10. Therefore, the phase can be more securely adjusted. Further, the buffer portion 10 is formed so as not to enter into the first expansion space 3 regardless of the above reciprocation of the first stage displacer 2 and the second stage displacer 5. Therefore, the pressure of the helium gas inside the buffer portion 10 can be stabilized to cause the inside of the buffer portion to function as a buffer portion. Further, the first flow resistor 9 is formed so as not to enter into the first expansion space 3 regardless of the above reciprocation of the first stage displacer 2 and the second stage displacer 5 in a manner similar to the buffer portion 10. Therefore, the flow rate coefficient of the first flow resistor 9 functioning as the orifice can be made constant along the entire region of the reciprocation thereby stabilizing a phase shifting function.

Within the first embodiment, it is possible to stabilize a phase shifting function in the first embodiment. Therefore, it is possible to stabilize the length and the phase of the virtual gas piston 8P and the above described function of the sealing portion. The leakage loss can be further secured. Furthermore, the refrigeration efficiency can be further securely enhanced by providing the third expansion space.

Second Embodiment

The second embodiment is described in detail next. Within the cryogenic refrigerator 1 of the first embodiment, the first flow resistor 9 is shaped like the groove extending in the axial direction on the outer peripheral surface of the second stage displacer 5. Further, it is possible to add a hole as a second flow resistor 17. The hole as the second flow resistor 17 is formed at the start end of the first flow resistor 9, extends in a radius direction of the second stage displacer 5 and communicates with the second regenerator 12. It is preferable to provide separators (not illustrated) above and below a portion of the second regenerator 12 communicating with the second flow resistor 17 to form a space without the regenerator material. Further, the diameter of the second flow resistor 17 is preferably smaller than the diameters of the lead spheres. For example, this is to avoid the lead spheres from escaping through the hole.

Figure 4:
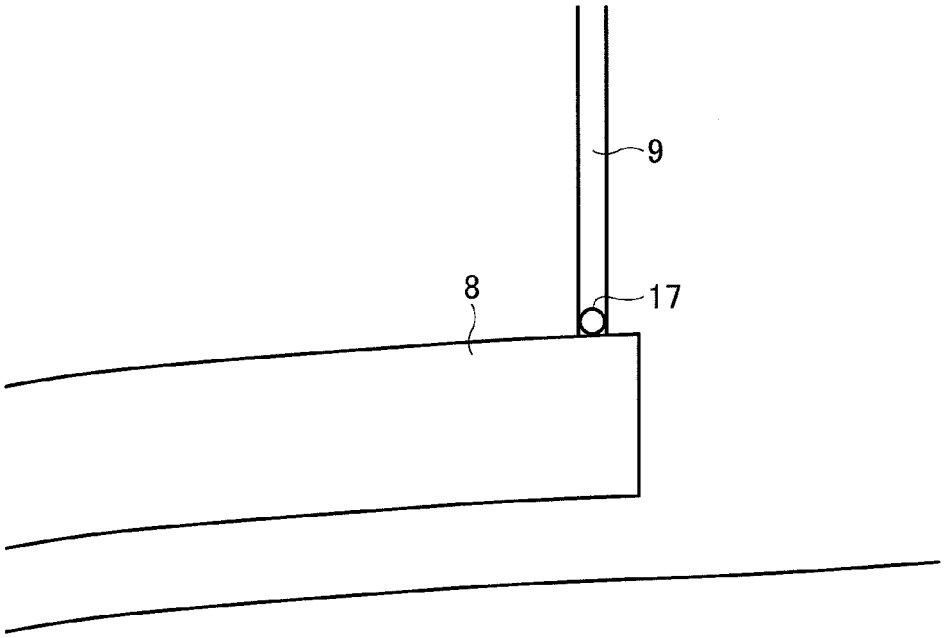
FIG. 4 schematically illustrates an exemplary cryogenic refrigerator of a second embodiment.

Within the second embodiment, the second flow resistor 17 is added to the structure of the first embodiment as illustrated in FIG. 4. The second flow resistor 17 is provided at the end on the high pressure side of the first flow resistor 9, extends inside along the radius direction of the second stage displacer 5, and communicates with the second regenerator 12. The flow chart is illustrated in FIG. 5.

The first flow resistor 9 corresponds to a virtual orifice arranged on a communicating passage for communication between a buffer portion 10 functioning as a buffer and the high temperature side of the helical groove 9 functioning as a pulse tube. Further, the second flow resistor 17 corresponds to a virtual double inlet orifice arranged in a communication passage for connecting the second regenerator 12 and the high temperature side of the helical groove 8 (a virtual pulse tube). Said differently, the helical groove 8 and the second regenerator 12 can be regarded as a double inlet type pulse tube refrigerator having a buffer volume.

Figure 5:
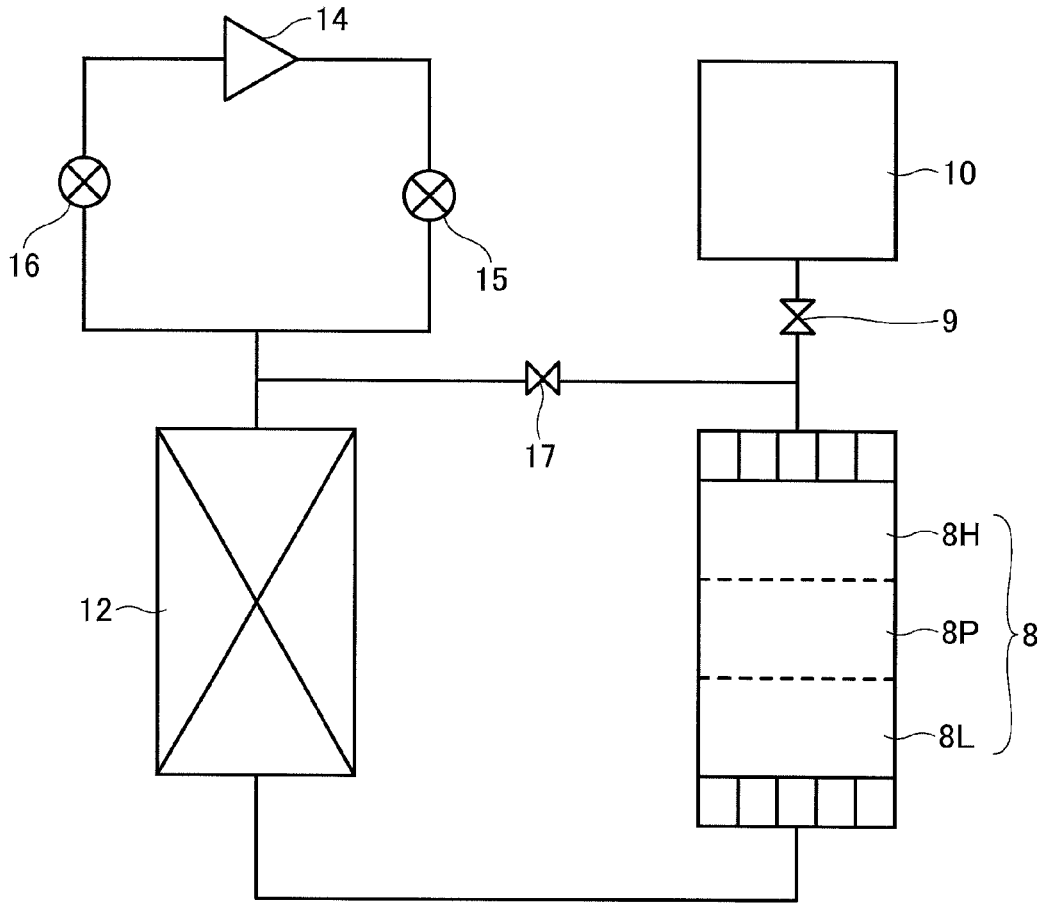
FIG. 5 schematically illustrates a flow of a gas in which a side clearance of the cryogenic refrigerator of the second embodiment is regarded as a pulse tube of a virtual pulse tube refrigerator.

The refrigerant gas inside the helical groove 8 corresponds to a virtual gas piston 8P (a substantially center portion of the helical groove 8) in FIG. 5 in a manner similar to the first embodiment. The length of the virtual gas piston 8P in the axial direction and the phase of the virtual gas piston 8P may be adjusted so that the virtual gas piston 8P is always accommodated inside the helical groove 8 during reciprocation of the helical groove 8 and so that a high temperature side space 8H exists on the high temperature side of the virtual gas piston 8P and a low temperature side space 8L exists on the low temperature side of the virtual gas piston 8P. The length of the virtual gas piston 8P in the axial direction and the phase of the virtual gas piston 8P are adjusted by changing the volume of the buffer portion (the buffer) 10 functioning as a phase shifting mechanism, the cross-sectional area of the first flow resistor (the orifice) 9, and the cross-sectional area of the second flow resistor 17.

Next, the operation of the refrigerator is described. At a certain time point of supplying the refrigerant gas, the first stage displacer 2 and the second stage displacer 5 are positioned at lower dead centers in the first stage cylinder 4 and the second stage cylinder 7, respectively. At this timing or a timing slightly different from this timing, a supply valve 15 is opened. Then, a high pressure helium gas is supplied inside the first stage cylinder 4 from a supply and discharge pipe via the supply valve 15. The high pressure helium gas flows inside the first stage displacer 2 (into the first regenerator 11) from an upper portion of the first stage displacer 2. The high pressure helium gas flowing inside the first regenerator 11 is supplied into a first expansion space 3 via a communicating passage positioned at the lower portion of the first stage displacer 2 while being cooled by a first regenerator material.

Most of the high pressure helium gas supplied to the first expansion space 3 is then supplied to the second regenerator 12 via a communication passage (not illustrated). Because the second stage displacer 5 includes a clearance sealing portion on the end portion on the high temperature side, it is possible to prevent the helium gas from flowing from the first expansion space 3 to the buffer portion 10.

At this time point, the pressure of the helium gas inside the helical groove 8 is substantially the same as the pressure of the compressor 14 on the low pressure side. Meanwhile, the helium gas inside the buffer portion 10 has a pressure which is an intermediate pressure between the high and low pressures of the compressor 14. Therefore, the helium gas inside the buffer portion 10 flows into the high temperature side of the helical groove 8 via the first flow resistor 9.

The high pressure helium gas flown into the second regenerator 12 is supplied to the second expansion space 6 via the communicating passage while being further cooled by the second regenerator material. A part of the high pressure helium gas supplied to the second expansion space 6 is supplied inside the helical groove 8 from the low temperature side. This gas corresponds to the helium gas existing inside the low temperature side space 8L in FIG. 5. Then, a part of the high pressure helium gas flown into the second regenerator 12 flows into the high temperature end of the helical groove 8 from the second flow resistor 17.

As described, since the cross-sectional areas of the first and second flow resistors 9 and 17 are smaller than the cross-sectional area of the helical groove 8, the inflow resistance of the helium gas flowing inside the helical groove 8 while flowing into the high temperature side space 8H from the buffer portion 10 and the second regenerator 12 is greater than the inflow resistance of the helium gas flowing inside the helical groove 8 while flowing into the low temperature side space 8L. Therefore, the amount of the helium gas flowing inside the high temperature side space 8H is smaller than the amount of the helium gas flowing inside the low temperature side space 8L thereby preventing the gas in the high temperature side space 8H from flowing into the second expansion space 6. On the other hand, a part of the helium gas in the high temperature side space 8H may be pushed by the virtual gas piston 8P so as to flow into the buffer portion 10.

As described, the first expansion space 3, the second expansion space 6 and the helical groove 8 are filled with the high pressure helium gas and the supply valve 15 is closed. At this time, the first stage displacer 2 and the second stage displacer 5 are positioned at the upper dead centers in the first stage cylinder 4 and the second stage cylinder 7, respectively. At this timing or a timing slightly different from this timing, the return valve 16 is opened. Then, the refrigerant gas inside the first expansion space 3, the second expansion space 6 and the helical groove 8 are depressurized to thereby expand. The helium gas inside the first expansion space 3 having a low temperature by the expansion absorbs heat of a first cooling stage (not illustrated) and the helium gas in the second expansion space 6 absorbs heat of a second cooling stage (not illustrated).

The first stage displacer 2 and the second stage displacer 5 move toward the lower dead centers thereby reducing the volumes of the first expansion space 3 and the second expansion space 6. The helium gas inside the second expansion space 6 is recovered into the first expansion space 3 via the second regenerator 12. The helium gas on the low temperature side space 8L in the helical groove 8 is recovered via the second expansion space 6. Meanwhile, a part of the helium gas in the helical groove 8 (the high temperature side space 8H) flows into the second regenerator 12 via the second flow resistor 17.

The helium gas in the first expansion space 3 returns to the compressor 14 via the first regenerator 11 to a suction side of the compressor 12. At this time, the first regenerator material and the second regenerator material are cooled by the refrigerant gas. These processes form one cycle. The first cooling stage and the second cooling stage are cooled by repeating the cycle.

Within the second embodiment, in a manner similar to the first embodiment, the helical groove 8 forming the side clearance between the outer peripheral surface of the second stage displacer 5 and the inner peripheral surface of the second stage cylinder 7 is regarded as a pulse tube refrigerator as illustrated in FIG. 5 to form the virtual gas piston 8P inside the helical groove 8. Then, the first flow resistor 9 having a constant flow rate coefficient is regarded as the orifice, and the second flow resistor 17 having a constant flow rate coefficient is regarded as the double inlet which connects the second regenerator 12 and the helical groove 8 as the virtual pulse tube. Thus, the length of the virtual gas piston 8P in the axial direction and the phase of the virtual gas piston 8P are further appropriately adjusted by changing the cross-sectional area of the first flow resistor 9 or the cross-sectional area of the second flow resistor 17.

Said differently, it becomes possible to enhance refrigeration efficiency by securely providing a sealing function to the virtual gas piston 82 to thereby prevent a leakage loss. Further, the refrigeration efficiency can also be enhanced by additionally cooling a cooling stage using a low temperature side space 8L of the helical groove 8 as a third expansion space.

Although the cryogenic refrigerator described above has the two stages of the displacers, the number of the stages may be changed to three or the like.

The cross-sectional area of the first flow resistor 9 may be changed by adjusting the depth, the width or both of the depth and the width. The shape of the cross-sectional area may be any one of a curved shape, a rectangular shape and so on. Although the above example is such that the first flow resistor 9 is linearly formed in the axial direction of the second stage displacer 5, the embodiments are not limited thereto. For example, the helical groove may be formed along an extended line. As long as the buffer portion 10 is connected to the high pressure end of the helical groove, an effect similar to the above is obtainable.

Within the above embodiments, an example that the cryogenic refrigerator is the GM refrigerator is described. However, the embodiments are not limited thereto. For example, the embodiments are applicable to any refrigerator having a displacer such as a Stirling type refrigerator and a Solvay type refrigerator.

As described, the embodiments provide the cryogenic refrigerator which can reduce the leakage loss in the side clearance is reduced and enhances the refrigeration efficiency by using the side clearance as the third expansion space.

As described, according to the embodiments, it is possible to securely adjust the length in the axial direction and the phase of the virtual gas piston in using the side clearance as the pulse tube refrigerator.

According to the cryogenic refrigerator of the embodiments, by regarding the side clearance on the outer peripheral side of the second stage displacer as the pulse refrigerator, the loss can be decreased after adjusting the phase. Thus, the refrigeration efficiency can be enhanced.

All examples and conditional language recited herein are intended for pedagogical purposes to aid the reader in understanding the embodiments and the concepts contributed by the inventor to furthering the art, and are to be construed as being without limitation to such specifically recited examples and conditions, nor does the organization of such examples in the specification relate to a showing of superiority or inferiority of the embodiments. Although the cryogenic refrigerator has been described in detail, it should be understood that the various changes, substitutions, and alterations could be made hereto without departing from the spirit and scope of the invention.

What is claimed is:

1. A cryogenic refrigerator comprising:

a first stage displacer;

a first stage cylinder configured to form a first expansion space between the first stage cylinder and the first stage displacer;

a second stage displacer connected to the first stage displacer; and a second stage cylinder configured to form a second expansion space between the second stage cylinder and the second stage displacer, wherein the second stage displacer includes a helical groove, a first flow resistor, a buffer portion, and a clearance sealing portion, which are formed on an outer peripheral surface of the second stage displacer so as to be arranged from a side of the second expansion space toward a side of the first stage displacer in an order of the helical groove, the buffer portion, and the clearance sealing portion, wherein the helical groove is formed so as to helically extend from the side of the second expansion space toward the side of the first stage displacer, wherein the first flow resistor communicates with the helical groove directly at an end of the helical groove and also communicates with the buffer portion directly at an end of the buffer portion, wherein the buffer portion includes an annular recess that is depressed from the clearance sealing portion of the second stage displacer in a radial direction of the second stage displacer and communicates with a side of the first stage displacer in the first flow resistor, and the buffer portion is separated from the helical groove and communicates with the helical groove through the first flow resistor, and wherein the clearance sealing portion exists between the first expansion space and the buffer portion in a longitudinal axis direction of the second stage displacer.

2. The cryogenic refrigerator according to claim 1, wherein the second stage displacer further includes a second flow resistor that includes a hole penetrating the second stage displacer in the radial direction of the second stage displacer and is configured to connect the helical groove on a side of the first stage displacer to a regeneration chamber inside the second stage displacer.

3. The cryogenic refrigerator according to claim 1, wherein when the first stage displacer is positioned at an upper dead center, at which the first expansion space is maximized, the buffer portion is positioned on a lower side of a bottom of the first expansion space.

* * * * *